United States Patent [19]

Madderra et al.

[11] Patent Number: 4,592,525

[45] Date of Patent: Jun. 3, 1986

[54] COUNTER-ROTATING FOLDING WINGS

[75] Inventors: Jimmy M. Madderra, Huntsville; John A. Schaeffel, Jr., Cullman, both of Ala.

[73] Assignee: The United States of America as represented by the Secretary of the Army, Washington, D.C.

[21] Appl. No.: 699,284

[22] Filed: Feb. 7, 1985

[51] Int. Cl.[4] ..... F42B 13/32

[52] U.S. Cl. ..... 244/3.28; 244/3.29

[58] Field of Search ..... 244/3.27, 3.28, 3.29, 244/3.24, 46, 3.25, 47, 49, 3.3, 3.26

[56] References Cited

U.S. PATENT DOCUMENTS 3,711,040 1/1973 Carver ..... 244/3.29

4,453,426 6/1984 Groutage et al. ..... 244/49

FOREIGN PATENT DOCUMENTS 2841773 4/1980 Fed. Rep. of Germany ..... 244/3.28

*Primary Examiner*—Deborah L. Kyle

*Assistant Examiner*—Michael Carone

*Attorney, Agent, or Firm*—Freddie M. Bush; James T. Deaton; Robert P. Gibson

[57] ABSTRACT

A missile which has folding wings at opposite side of the missile and extending longitudinally of the missile for allowing high density packaging of the missile in a launcher or container and the folding wings are deployed after the missile is ejected from a launcher or otherwise extended to a launch position to provide a cruciformed shaped wing structure about said missile for accurate guidance thereof.

6 Claims, 10 Drawing Figures

COUNTER-ROTATING FOLDING WINGS

DEDICATORY CLAUSE

The invention described herein may be manufactured, used, and licensed by or for the Government for governmental purposes without the payment to us of any royalties thereon.

BACKGROUND OF THE INVENTION

In the past, much experimenting with a number of wing deployment arrangements for cruise type missiles have been posed, but these arrangements have not been completely acceptable for applicants' purposes. A need exists for a folding wing arrangement which allows high density packaging of the missile with the wings thereon in a launcher or container. The wings must be such that they can be deployed after the missile has been ejected from a launcher canister or deployed after the missile has been extended to a launch position from a container.

Therefore, it is an object of this invention to provide a counter rotating folding wings arrangement in which four wing structures are mounted with a pair of the wing structures on opposite sides of a missile and being rotatable and pivotable to equally spaced positions around the periphery of a missile.

Another object of this invention is to provide a folding wing arrangement in which the wings are readily storable with the missile in a container.

Another object of this invention is to provide a folding wing arrangement in which the wings can be of ample size to provide proper stabilization of the missile in flight.

Other objects and advantages of this invention will be obvious to those skilled in this art.

SUMMARY OF THE INVENTION

In accordance with this invention, two wing assemblies are pivotably mounted 180° apart on opposite sides of a missile with each wing assembly consisting of two wing panels that are hinged to a center section. The wing assemblies can be rotated 90° to a position where the two wing panels at its respective side are spring biased to fold out 45° each and lock in this position so that the two wing assemblies when mounted in position for flight form a cruciform wing arrangement.

DESCRIPTION OF THE PREFERRED EMBODIMENT

Figure 4:
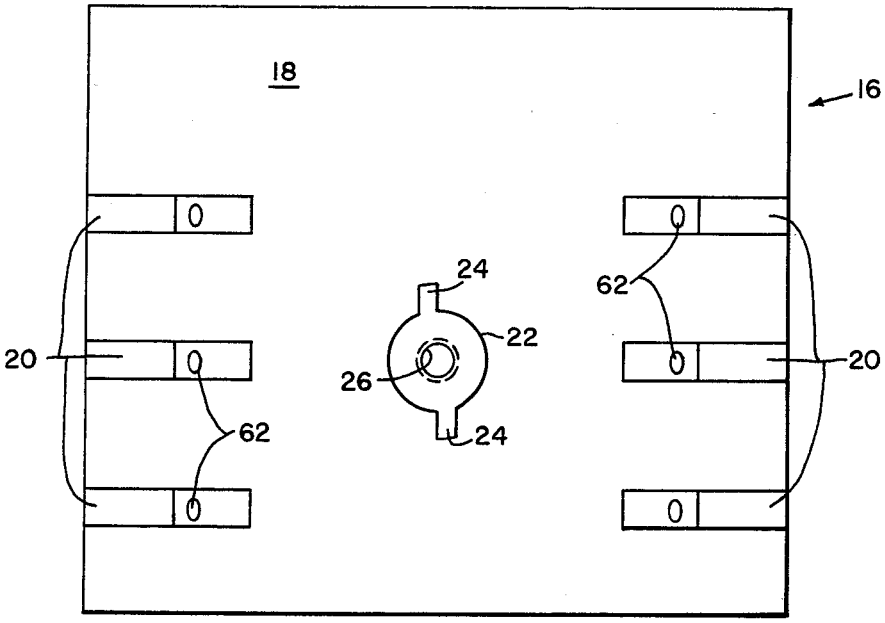
FIG. 4 is a top view of the base about which the wing structure is rotated.
Figure 6:
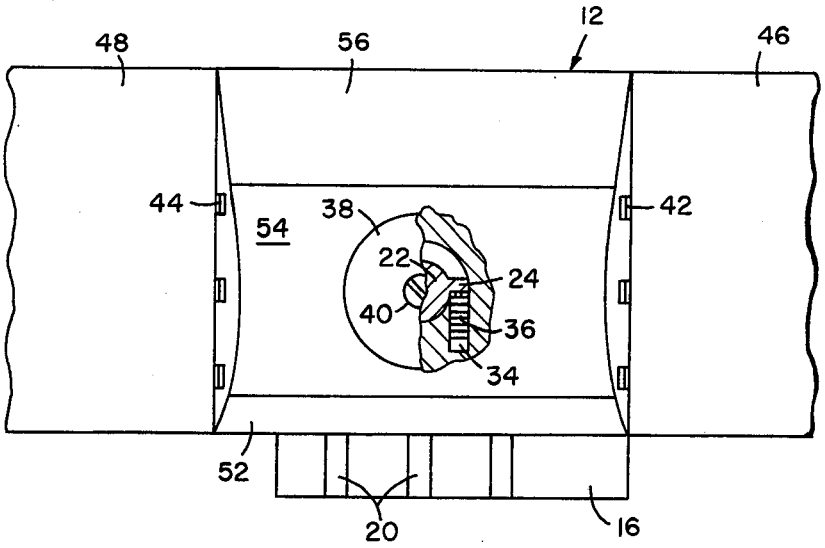
FIG. 6 is a top view and partially in section illustrating the wing structure.
Figure 5:
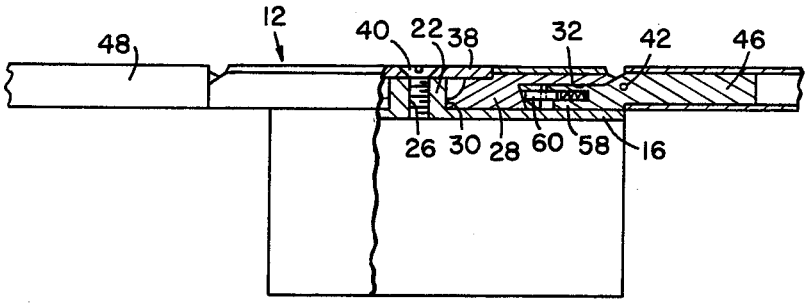
FIG. 5 is a view partially in section illustrating the wing structure mounted to the base plate.
Figure 8:
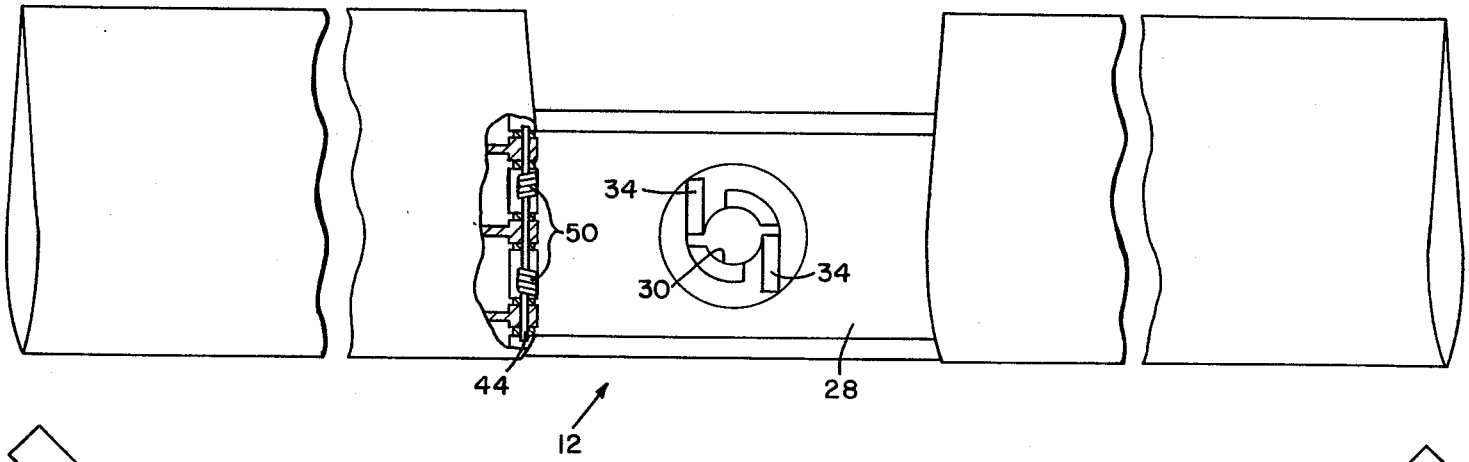
FIG. 8 is a top view of the wing structure in the position as illustrated in FIG. 7.
Figure 7:
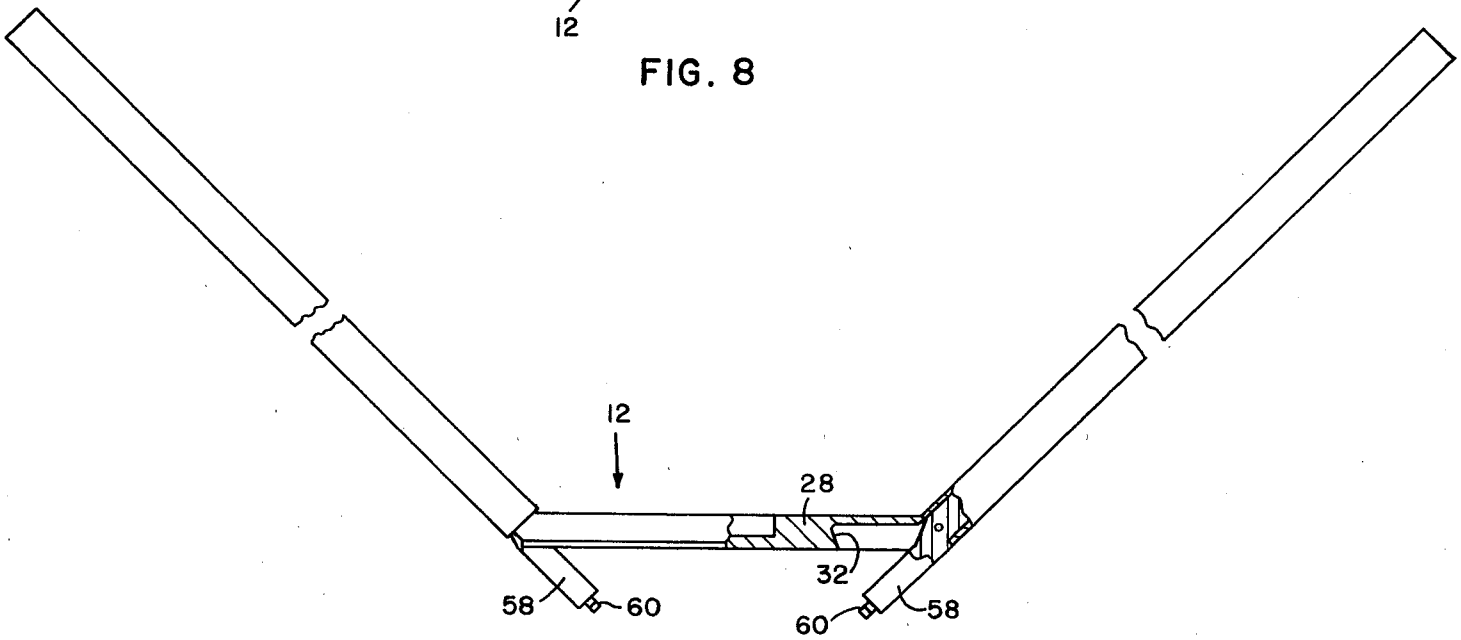
FIG. 7 illustrates the wing structure in the flight position and partially in section as illustrated.
Figure 9:
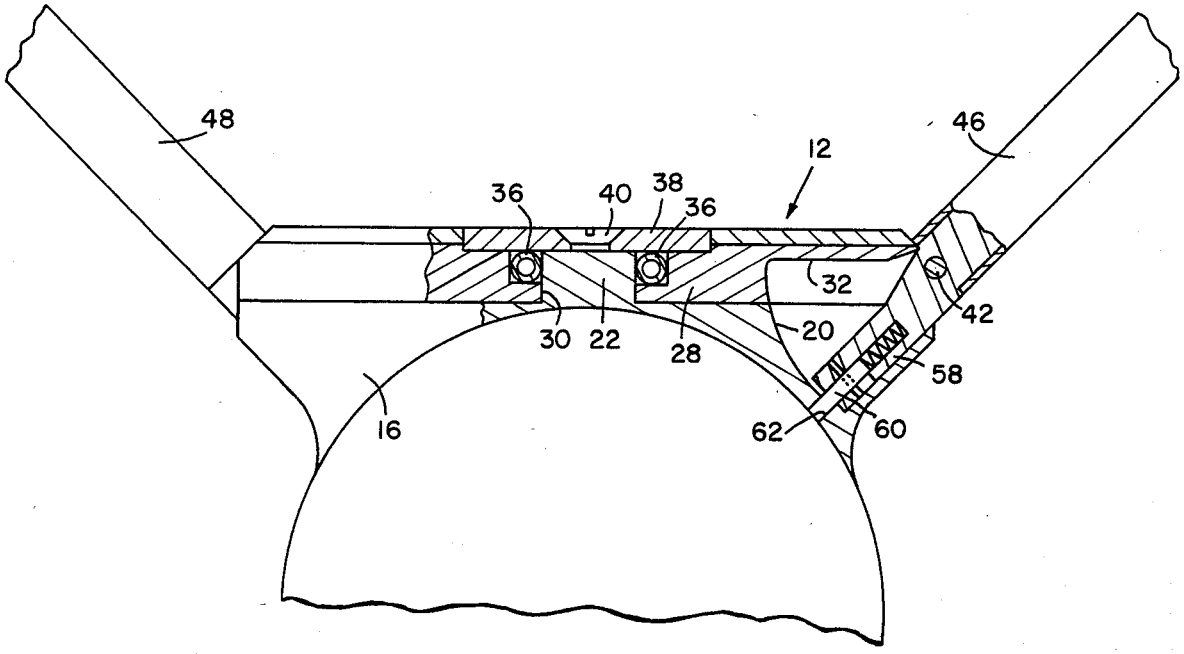
FIG. 9 is a view illustrating one of the wing panels in the flight position and in a locked condition.
Figure 10:
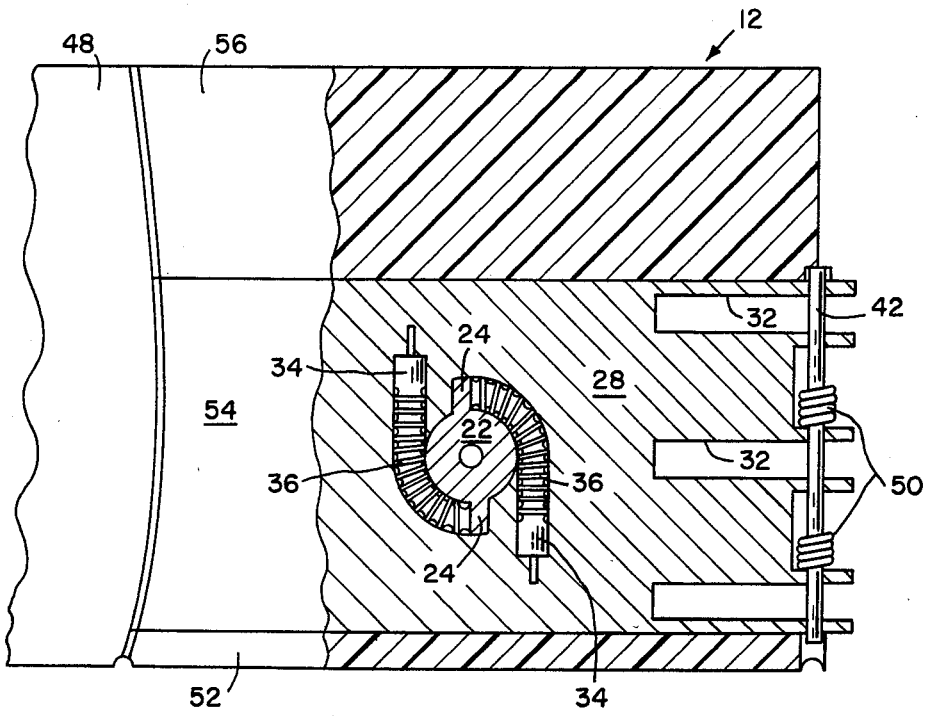
FIG. 10 is a view partially cut-away and partially in section and illustrating the bellows actuates in their position with the wing assembly perpendiculator to the missile center axis.

Referring now to the drawing, a missile 10 has two wing assemblies 12 and 14 mounted on opposite sides of missile 10 and spaced 180° apart. Wing assemblies 12 and 14 are each mounted to missile 10 in a conventional manner by base sections 16. Each base section 16 is made integral with or secured to the missile in a conventional manner to be spaced on opposite sides of the missile as illustrated. Each base section 16 has a flat outer surface 18 (see FIG. 4), six locking detent grooves 20 and a mounting stud 22 with ears 24. Mounting stud 22 has a threaded opening 26 therein. A center member 28 (see FIGS. 5–8) of each wing assembly has over and under flat surfaces except for removed portions. Center member 28 has an opening 30 therethrough for insertion over stud 22 and ears 24 to allow center member 28 to be rotated about stud 22. The under surface of center member 28 has six grooved out sections 32 that are spaced for alignment over locking detent grooves 20 in an aligned position of center member 28 with base section 16. Center member 28 has milled out sections 34 with powered bellows actuators 36 mounted therein (see FIG. 6) for actuating the assembly 90° about stud 22 to the position illustrated in FIG. 10. A plate 38 is secured by stud 40 to threaded bore 26 in stud 22 to secure center member 28 to base section 16 (see FIG. 5). Bellows actuators 36 are nonexploding gas generator type devices that convert their energy to expanded gases and mechanical working action through the expanding bellows thereof.

Figure 1:
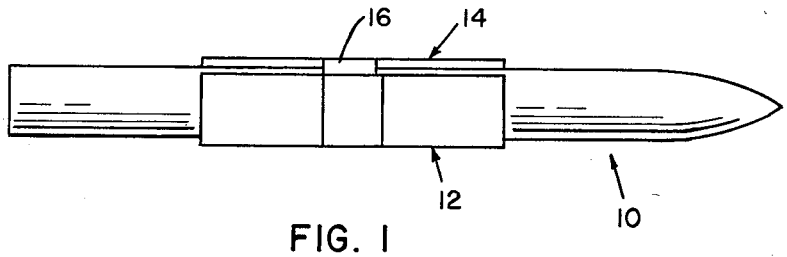
FIG. 1 is a side view of a missile with the wing assemblies mounted thereon.
Figure 3:
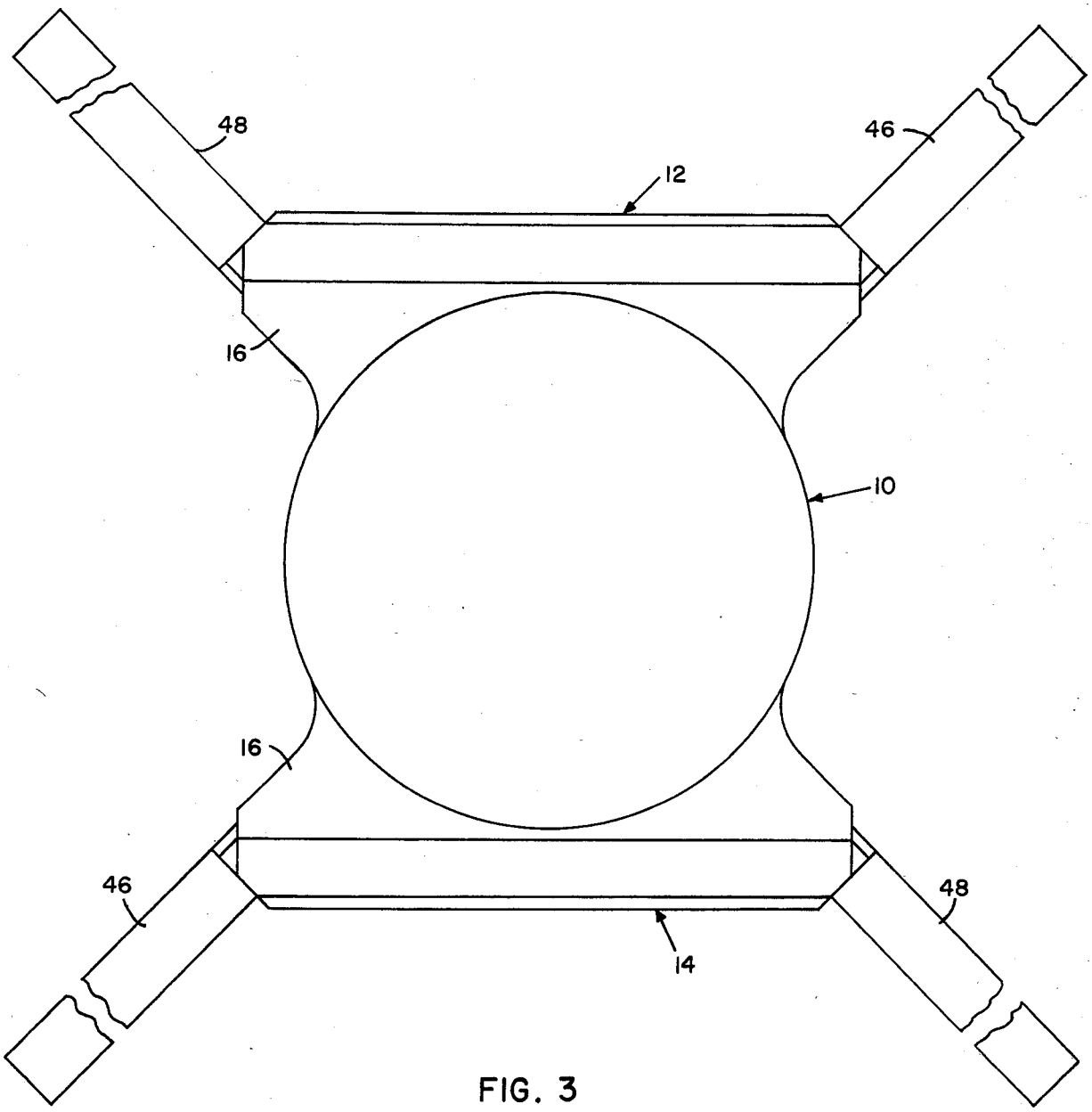
FIG. 3 is a top view looking vertically down on the missile and illustrating the wing assemblies mounted on the missile and actuated into the deployment cruciform position.
Figure 2:
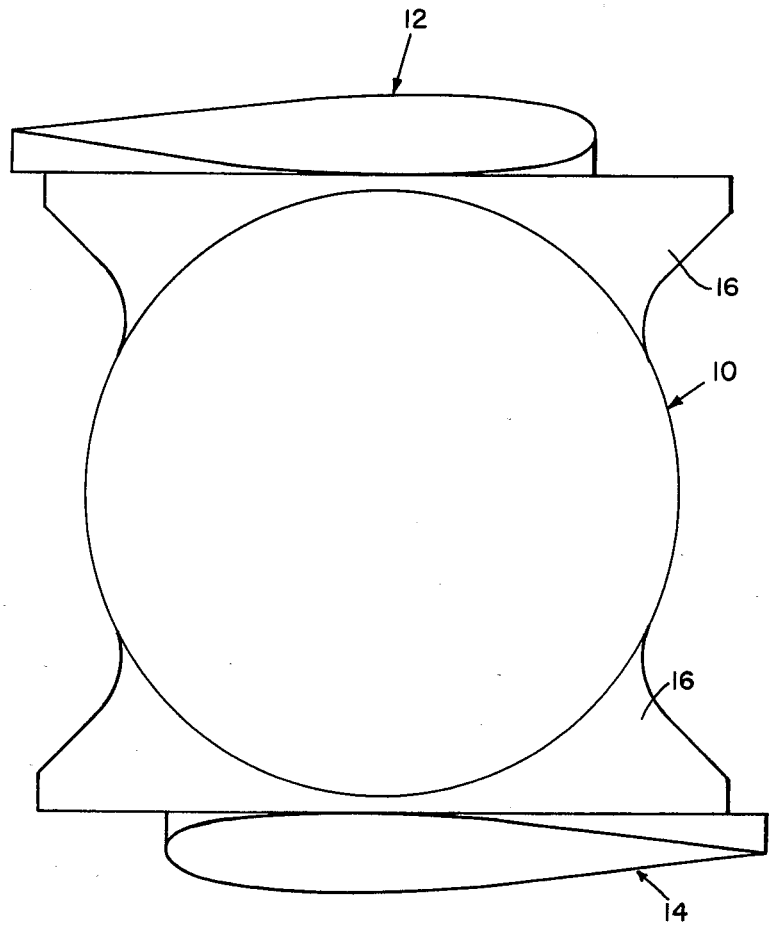
FIG. 2 is a front view illustrating a missile with the two wing assemblies mounted thereon.

Center member 28 has pivot pins 42 and 44 mounted at opposite sides thereof and wing panel assemblies 46 and 48 are pivotably mounted to pivot pins 42 and 44 respectively. Pivot pins 42 and 44 each have torsion springs 50 (see FIGS. 8 and 10) mounted thereon and torsion springs 50 act between center member 28 and the respective wing panel assembly to bias the wing panel assemblies to positions in which the wing panel assemblies are at 90° angles to each other relative to a center line through the missile. As can be seen, wing panel assemblies 46 and 48 are streamlined in structure as illustrated. Wing panel assembies 46 and 48 are preferrably made of composite materials to provide a light weight structure and also a structure that has sufficient strength to hold its shape against substantial bending forces. Center member 28 also has a front section 52 that is contoured to match the adjacent front portion of wing panel assemblies 46 and 48, and an intermediate section 54 and a trailing section 56 that are contoured to the same outer contour as the adjacent portions of wing panel assemblies 46 and 48. Contoured front section 52, intermediate section 54 and rear section 56 are secured to center member 28 in a conventional manner. Each wing panel assembly 46 and 48 has three projecting fingers 58 for being housed in grooves 32 in the folded up position and being pivotable into locking detent grooves 20 in the spring biased outward position. Each finger 58 has a spring biased detent locking member 60 that projects into detent opening 62 in each locking detent groove 20. With detent locking members 60 projecting into openings 62, wing panel assemblies 46 and 48 are locked in their spring bias position to form the cruciform configuration illustrated in FIG. 3.

In operation, missile 10 and wing assemblies 12 and 14 are stored in a container or a launch tube structure with the wing assemblies 12 and 14 on opposite sides of the missile and extending longitudinally of the missile. When it is desired to deploy missile 10, the missile and wing assemblies are moved in a conventional manner from the container or launch tube and powered bellows actuators 36 are simultaneously ignited in a conventional manner to cause the wing assemblies to be rotated about mounting stud 22 by the pressure in each bellows actuator 36 acting between its mounting in center member 28 and ears 24 on stud 22. This rotates the wing assemblies 90° to a position where fingers 58 are aligned with locking detent grooves 20 in base section 16. With fingers 58 aligned with locking detent grooves 20, torsion springs 50 actuate wing assemblies 46 and 48 45° each relative to base member 28 and into a position where each of wings 46 and 48 are equally spaced about missile 10 and into the cruciform configuration illustrated in FIG. 3. In this position, the spring biased locking detent members 60 project into detent openings 62 in each of locking detent grooves 20 and spring biased locking members 60 therefore lock each wing panel assembly 46 and 48 in the outward flight position illustrated in FIG. 3. Missile 10 is then ready to be launched.

As can be seen, this particular wing assembly is relatively compact in comparison to the size of the guiding wing assemblies and can be easily stored longitudinally of the missile for shipping and for storage until the missile is ready to be fired at a desired target. Wing assemblies 46 and 48 are made of composite material and are of light weight material but of material that has ample strength that resist flexing and bending of these wings under normal stresses. Therefore, it can be appreciated that this wing assembly structure is very desirable in its ability to cause one to be able to accurately control the flight of missile 10.

We claim:

1. A missile having two foldable wing assemblies rotatably mounted on opposite sides of the missile and extending longitudinally of the missile with each wing assembly including a center member and a pair of wing panels mounted thereto, each wing assembly being rotatable 90° about its mounting to position the center member and the wing panels from longitudinally of the missile to a position perpendicular to an axis along a longitudinal center line of the missile, said wing panels each being mounted by being pivoted to said center member and being spring biased outward toward each other to cause the wing panels to pivot to a position in which the wing panels form a right angle to each other from the longitudinal center line of said missile and to position the wing panels of the two wing assemblies in a cruciform shaped configuration of the wing panels relative to said missile.

2. A missile as set forth in claim 1, wherein said center member has actuating means mounted therein for actuating the wing assemblies to the position perpendicular to the axis of said missile, and said wing panels each having locking means for locking each wing panel in its cruciform position.

3. A missile as set forth in claim 2, wherein each wing panel is streamlined in structure from a front leading edge to a rear surface thereof.

4. A missile as set forth in claim 2, wherein said locking means includes fingers on each wing panel and cutout grooves on said center member and locking detent grooves in a supporting structure on said missile, and including a spring bias detent in each finger that engages an opening in each locking detent groove to lock said panels in flight position.

5. A missile as set forth in claim 4, wherein said actuating means includes powered bellows actuators.

6. A missile as set forth in claim 5, wherein said supporting structure has a projecting stud with ears thereon that provide a portion of said mounting for each wing assembly, and said powered bellows actuators acting between said center member and said ears to rotate said wing assembly for said 90°.

* * * * *